United States Patent [19]

Beer

[11] 3,968,898

[45] July 13, 1976

[54] MAGNETOSTRICTIVE CLOSURE MEMBER

[76] Inventor: Andrew E. Beer, 25 Sutton Place, New York, N.Y. 10022

[22] Filed: Aug. 26, 1974

[21] Appl. No.: 500,334

[52] U.S. Cl. ..... 220/260; 49/34; 49/40; 251/129; 220/213; 220/334; 46/238; 46/239

[51] Int. Cl.[2] ..... B65D 41/02; B65D 43/14

[58] Field of Search ..... 220/213, 334, 335, 260; 46/238, 239; 251/129; 49/34, 40

[56] References Cited

UNITED STATES PATENTS 3,638,153 1/1972 Sparrow ..... 251/129

3,857,543 12/1974 McKeen ..... 251/129

*Primary Examiner*—George T. Hall

*Attorney, Agent, or Firm*—Brumbaugh, Graves, Donohue & Raymond

[57] ABSTRACT

A bimetallic closure member comprised of two materials having dissimilar magnetostrictive characteristics does not require a hinge, when subjected to a magnetic field, or alternatively, when removed from a magnetic field, the materials contract or expand at different rates causing the member to bend thereby opening or closing the closure member.

6 Claims, 5 Drawing Figures

MAGNETOSTRICTIVE CLOSURE MEMBER

BACKGROUND OF THE INVENTION

Bimetallic thermal strips comprised of two metals having dissimilar thermal expansion rates are well known and are used in various temperature actuated devices such as thermostats and circuit breakers. The principle by which such bimetallic strips operate depends upon the dissimilar rates of thermal expansion of the two materials. The strip bends toward the material having the lower rate of thermal expansion when the strip is heated. Alternatively, the strip bends toward the material having the higher rate of the expansion when the strip is cooled.

Similarly, the principle of magnetostriction relates to the expansion which a magnetostrictive material undergoes when subjected to a magnetic field. Bimetallic magnetostrictive strips operate on a principle similar to bimetallic thermal strips. Bimetallic magnetostrictive strips have been used heretofore and are shown in U.S. Pat. No. 2,475,148 issued on July 5, 1949 to F. Massa for TRANSDUCER MEANS, U.S. Pat. No. 2,764,647 issued on July 25, 1956 to W. G. Leslie et al for a MAGNETOSTRICTIVE RELAY, and in U.S. Pat. No. 3,216,131 issued on Nov. 9, 1965 to J. Singerman for a MAGNETOSTRICTION TEACHING DEVICE. The construction and operation of magnetostrictive strips is further shown and explained in these patents. However, the utility of a magnetostrictive strip as a closure device has not heretofore been recognized.

SUMMARY OF THE INVENTION

In accordance with the invention a magnetostrictive closure member comprises a housing having an opening adapted to receive closure means and closure means adapted to close the opening in the housing. The closure member further comprises a bimetallic magnetostrictive strip which operates the closure means. One end of the magnetostrictive strip is attached to the closure means and the other end of the magnetostrictive strip is attached to the housing.

In some embodiments of the present invention, the magnetostrictive strip may also comprise the closure means.

DESCRIPTION OF THE PREFERRED EMBODIMENTS

Figure 1:
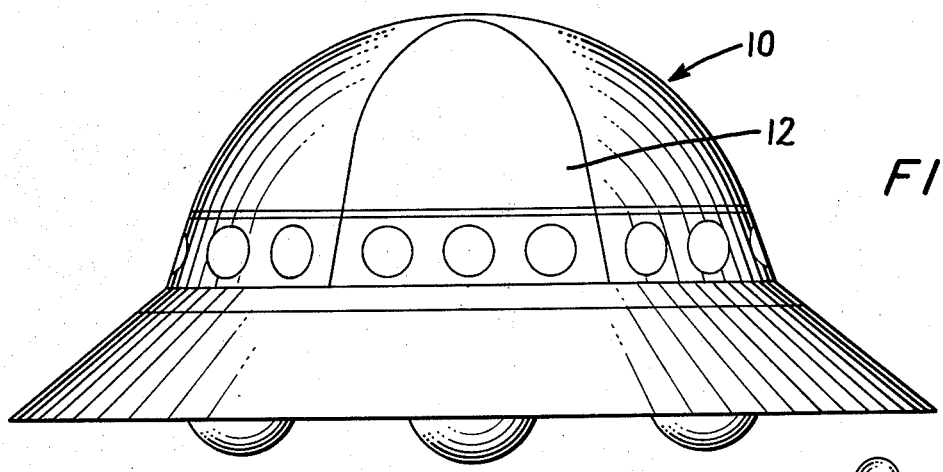
FIG. 1 is a front view of a novelty candy container in the form of a "flying saucer" which uses a magnetostrictive closure member in accordance with a first embodiment of the present invention.

Referring generally to FIg. 1, a container 10 in the form of a "flying saucer" is shown. The container 10 may be made of any suitable material, such as a plastic or a metal, and it includes a magnetostrictive closure member or door 12 made of a strip of two materials having dissimilar magnetostrictive characteristics. The container 10 may be used as a novelty device to hold candy or similar articles. However, it should be recognized that the magnetostrictive door 12 of the present invention should not be limited as a curiosity device.

Figure 2:
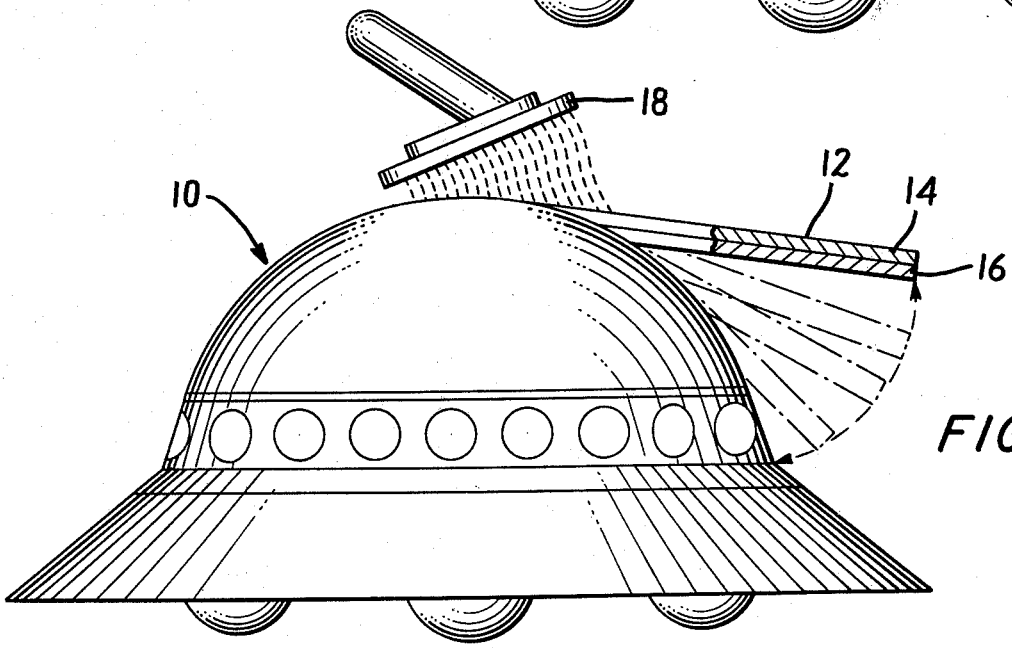
FIG. 2 is a front view of the candy container of FIG. 1 with the closure member in its open position.

Referring generally to FIg. 2, a side view of the container 10 is shown. The magnetostrictive door 12 is comprised of two metals 14, 16 having different magnetostrictive characteristics. A magnet 18, which may be either a permanent magnet or an electromagnet, is shown in close proximity to the magnetostrictive door 12. The magnetic field produced by the magnet 18 acts upon the metals 14, 16 such that the material 16 on the inside portion of the door 12 expands relative to the material 14 on the outside portion of the door 12. The relative expansion of the inner material 16 with respect to the outer material 14 causes the door 12 to open by bending outward. The opening of the door 12 is not dependent upon the presence of a hinge of any sort, but only upon the relative difference in the expansion rates of the magnetostrictive materials 14, 16 in the presence of a magnetic field.

Figure 3:
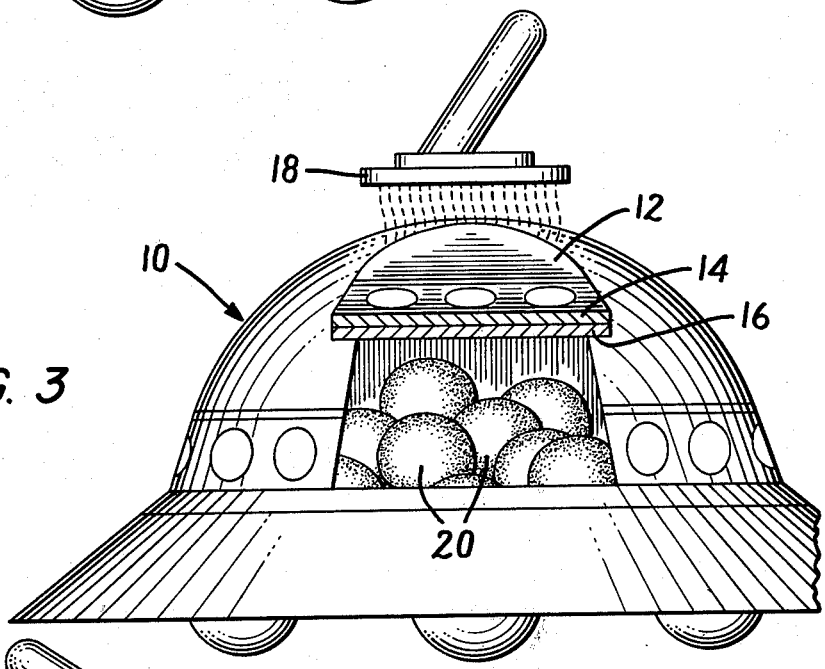
FIG. 3 is a side view of the candy container of FIG. 2.

Referring generally to FIG. 3 a front view of the container 10 with the door 12 in its open position is shown. When the door 12 is bent upward by a field from the magnet 18 the interior of the container 10 is exposed. Articles within the container 10 such as pieces of candy 20 are exposed.

Removal of the magnet 18 from proximity with the door 12 allows the materials 14, 16 to return to their site prior to magnetostriction. In the embodiment of FIGS. 1–3, the door 12 will close.

Figure 4:
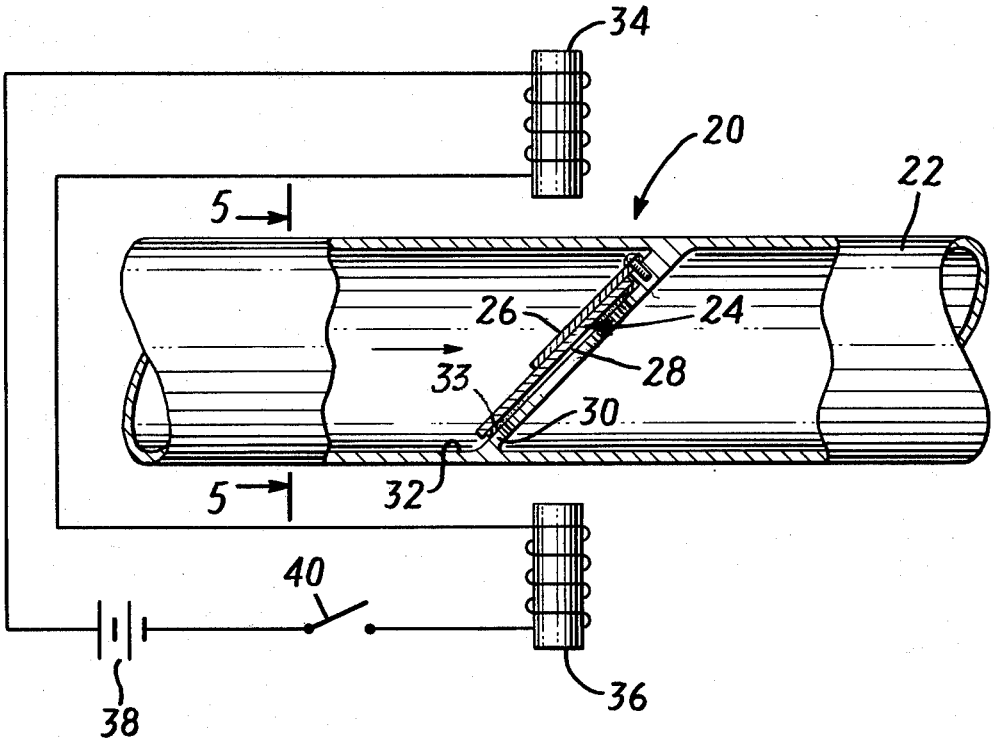
FIG. 4 is a partially cut away sectional view of a second embodiment of the present invention as used in a remotely controlled valve.
Figure 5:
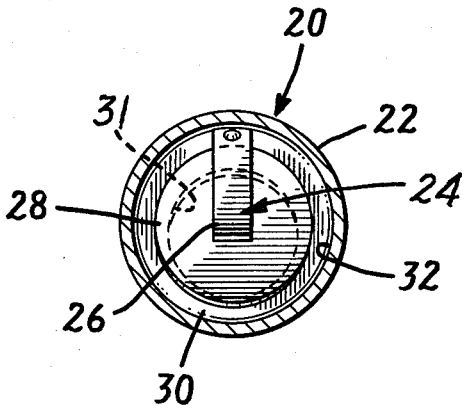
FIG. 5 a front view of the embodiment of FIG. 4.

Referring generally to FIGS. 4 and 5, a magnetostrictive valve 20 for remotely controlling fluid flow is shown enclosed in a portion of a sealed pipe 22. The valve 20 includes a bimetallic magnetostrictive closure member 24 comprised of two materials 26, 28 having different magnetostrictive expansion rates. The valve 20 is further comprised of a housing portion 30 having an opening 31 and connected to the inside wall 32 of the pipe 22. In a pipe 22 having a circular cross-section, the housing 30 comprises an annular ring extending around and sealed to the interior wall 32 of the pipe 22. A ring seal 33 is also located on the plate 28 to ensure against leakage through the valve 20. The housing 30 of the valve 20 is preferrably mounted at an angle to the direction of fluid flow (shown by an arrow in FIG. 4).

Mounted outside of the pipe 22 and on either side of the valve or closure member 24 are a pair of electromagnets 34, 36. The electromagnets 34, 36 provide a magnetic field when energized by a voltage supply 38. A switch 40 is used to interrupt the current flow through the electromagnets 34, 36 to remove the magnetic field from between the electromagnets 34, 36.

In operation, the valve 20 is normally biased to a closed position and sealed by the ring 32 whereby no fluid flow takes place through the closure member 24. The closure member 24 is opened by closing the switch 40 to establish a magnetic field between the electromagnets 34, 36. The magnetostrictive material 28 closest to the closure member 24 has a higher coefficient of magnetostrictive expansion than the magnetostrictive material 26 away from the closure member 24. A magnetic field between the electromagnets 34, 36 causes the magnetostrictive materials to bend to the broken line position indicated in FIG. 4, thus moving the closure member 24 away from the housing 30. Since the closure member 24 is now substantially parallel to the flow of fluid, it provides minimal obstruction to fluid flow. Thus, the fluid flow within the pipe 22 can be remotely controlled from outside the pipe 22. The magnetostrictive valve 20 is especially useful in applications where the controlled fluid is of a toxic or corrosive nature.

I claim:

1. A magnetostrictive closure member comprising:

a. a housing having an opening adapted to receive closure means;

b. closure means adapted to open or close the opening in said housing; and c. a bimetallic magnetostrictive strip adapted to operate said closure means, one metallic component of said bimetallic strip being attached to said closure means and having a magnetostrictive property different from the other metallic component of said bimetallic strip, said other metallic component being attached to said housing, such that the bimetallic strip, when subjected to a change of magnetic field, operates the closure means to open or close the opening.

2. The magnetostrictive closure member of claim 1, wherein said bimetallic magnetostrictive strip has a predetermined curvature when not subjected to a magnetic field and said curvature changes as it becomes subject to a magnetic field with the curvature being related to the intensity of the magnetic field.

3. A magnetostrictive closure member comprising a housing having an opening adapted to receive closure means, said closure means adapted to close said opening in said housing, and a bimetallic magnetostrictive strip adapted to operate said closure means, one end of said magnetostrictive strip being attached to said closure means and the other end of said magnetostrictive strip being attached to said housing wherein the housing comprises a container used for holding objects and the closure means comprises a door which allows access to the container.

4. The magnetostrictive closure member of claim 1, further comprising magnetic means for operating said closure member.

5. The magnetostrictive closure member of claim 4, wherein said magnetic means comprises a permanent magnet.

6. The magnetostrictive closure member of claim 4, wherein said magnetic means comprises an electromagnet.

* * * * *